US009682384B2

(12) United States Patent
Afanasiev et al.

(10) Patent No.: US 9,682,384 B2
(45) Date of Patent: Jun. 20, 2017

(54) ELECTROSTATIC PRECIPITATOR

(71) Applicant: University of Washington, Seattle, WA (US)

(72) Inventors: Andrei Afanasiev, Seattle, WA (US); Alexander V. Mamishev, Seattle, WA (US)

(73) Assignee: University of Washington, Seattle, WA (US)

( * ) Notice: Subject to any disclaimer, the term of this patent is extended or adjusted under 35 U.S.C. 154(b) by 65 days.

(21) Appl. No.: 14/851,510

(22) Filed: Sep. 11, 2015

(65) Prior Publication Data

US 2016/0074877 A1 Mar. 17, 2016

Related U.S. Application Data

(60) Provisional application No. 62/049,297, filed on Sep. 11, 2014.

(51) Int. Cl.

| | |
|---|---|
| ***B03C 3/45*** | (2006.01) |
| ***B03C 3/08*** | (2006.01) |
| ***B03C 3/12*** | (2006.01) |
| ***B03C 3/41*** | (2006.01) |
| ***B03C 3/47*** | (2006.01) |
| ***B03C 3/60*** | (2006.01) |
| ***B03C 3/66*** | (2006.01) |
| ***B03C 3/70*** | (2006.01) |

(52) U.S. Cl.

CPC ..... *B03C 3/08* (2013.01); *B03C 3/12* (2013.01); *B03C 3/41* (2013.01); *B03C 3/47* (2013.01); *B03C 3/60* (2013.01); *B03C 3/66* (2013.01); *B03C 3/70* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 3,650,092 | A * | 3/1972 | Gourdine | B03C 3/12 | 310/11 |
| 4,018,577 | A * | 4/1977 | Shibuya | B03C 3/38 | 96/78 |
| 5,055,118 | A * | 10/1991 | Nagoshi | B03C 3/60 | 96/77 |
| 6,004,376 | A * | 12/1999 | Frank | B03C 3/025 | 95/79 |

(Continued)

OTHER PUBLICATIONS

Adamiak, et al.,, "Simulation of corona discharge in point-plane configuration," Journal of Electrostatics, vol. 61, No. 2, pp. 85-98, 2004.

(Continued)

*Primary Examiner* — Christopher P Jones
*Assistant Examiner* — Sonji Turner
(74) *Attorney, Agent, or Firm* — McDonnell Boehnen Hulbert & Berghoff LLP

(57) ABSTRACT

An electrostatic precipitator may have a set of collector electrodes and a set of repelling electrodes. The conductive portions of the collector electrodes and/or the repelling may be arranged in segments. The segments may have differing electrical properties or may be electrically isolated to facilitate differing potentials along an airflow path. The differing potentials results in differing electric field strengths along the airflow path.

6 Claims, 2 Drawing Sheets

(56) References Cited

U.S. PATENT DOCUMENTS

| | | | | |
|---|---|---|---|---|
| 6,727,657 | B2 * | 4/2004 | Krichtafovitch | H05H 1/24 310/308 |
| 6,805,732 | B1 * | 10/2004 | Billiotte | A61L 9/22 264/129 |
| 7,758,675 | B2 * | 7/2010 | Naito | B01D 53/32 55/DIG. 38 |
| 8,002,876 | B2 * | 8/2011 | Frank | B03C 3/025 95/73 |
| 8,690,998 | B2 * | 4/2014 | Ji | B03C 3/08 96/79 |
| 2007/0245898 | A1 * | 10/2007 | Naito | B01D 53/32 96/65 |
| 2008/0047434 | A1 * | 2/2008 | Kobayashi | B03C 3/08 96/95 |
| 2009/0261268 | A1 * | 10/2009 | Schwiebert | B03C 3/41 250/424 |
| 2012/0000627 | A1 * | 1/2012 | Jewell-Larsen | B03C 3/025 165/96 |

OTHER PUBLICATIONS

Brocilo, et al.,, "Modeling of electrode geometry effects on dust collection efficiency of wire-plate electrostatic precipitators," Proceedings of the 8th International Conference on Electrostatic Precipitation, pp. 1-18, 2001.

Cardello, et al., "Technical note: performance of a personal electrostatic precipitator particle sampler," Aerosol Science and Technology, vol. 36, pp. 162-165, 2002.

Chang, et al., "Corona discharge processes," IEEE Transactions on Plasma Science, vol. 19, No. 6, pp. 1152-1166, 1991.

Chang, J-S, "Next generation integrated electrostatic gas cleaning systems," Journal of Electrostatics, vol. 57, No. 3-4, pp. 273-291, 2003.

Chun, et al., "Numerical modeling of near corona wire electrohydrodynamic flow in a wire-plate electrostatic precipitator," IEEE Transactions on Dielectrics and Electrical Insulation, vol. 14, No. 1, pp. 119-124, 2007.

Deutsch, W., "Bewegung und ladung der elektrizittstrger im zylinderkondensator," Annalen der Physik, vol. 373, No. 12, pp. 335-344, 1922.

Durga Prasad, et al., "Automatic control and management of electrostatic precipitator," IEEE Transactions on Industry Applications, vol. 35, No. 3, pp. 561-567, 1999.

Zukeran, et al., "Two-stage-type electrostatic precipitator re-entrainment phenomena under diesel flue gases," IEEE Transactions on Industry Applications, vol. 35, No. 2, pp. 346-351, 1999.

Ferge, et al., "Particle collection efficiency and particle re-entrainment of an electrostatic precipitator in a sewage sludge incineration plant," Environmental Science and Technology, vol. 38, No. 5, pp. 1545-1553, 2004.

Jedrusik, M. et al., "The influence of unburned carbon particles on electrostatic precipitator collection efficiency," 13th International Conference on Electrostatics, Journal of Physics: Conference Series, vol. 301, No. 1, 012009 (4 pages), 2011.

Jedrusik, M., "Effect of the particle diameter and corona electrode geometry on the particle migration velocity in electrostatic precipitators," Journal of Electrostatics, vol. 51-52, pp. 245-251, 2001.

Jewell-Larsen, et al., "CFD analysis of electrostatic fluid accelerators for forced convection cooling," IEEE Transactions on Dielectrics and Electrical Insulation, vol. 15, No. 6, pp. 1745-1753, 2008.

Jewell-Larsen, et al., "Coupled-physics modeling of electrostatic fluid accelerators for forced convection cooling," Proceedings of the 9th AIAA/ASME Joint Thermophysics and Heat Transfer Conference, vol. 3, pp. 2038-2047, 2006.

Kim, et al., "Experimental study of electrostatic precipitator performance and comparison with existing theoretical prediction models," Journal of Electrostatics, vol. 48, No. 1, pp. 42454, 1999.

Krichtafovitch, et al., "Design of an electronic air cleaner with porous collecting electrodes," Proceedings of the 2013 ESA Annual Meeting on Electrostatics, vol. C5, pp. 1-8, 2013.

Meij, et al., "The emissions and environmental impact of PM10 and trace elements from a modern coal-fired power plant equipped with ESP and wet FGD," Fuel Processing Technology, vol. 85, No. 6-7, pp. 641-656, 2004.

Mizuno, "Electrostatic Precipitation," IEEE Transactions on Dielectrics and Electrical Insulation, vol. 7, No. 5, pp. 515-624, 2000.

Moreau, et al., "Enhancing the mechanical efficiency of electric wind in corona discharges," Journal of Electrostatics, vol. 66, No. 1-2, pp. 39-44, 2008.

Nashimoto, "The effects of electrode materials on O3 and NOx emissions by corona discharging," Journal of Imaging Science, vol. 32, No. 5, pp. 205-210, 1988.

Ohyama, et al., "Numerical modeling of wire-plate electrostatic precipitator for control of submicron and ultra fine particles," Journal of Aerosol Science, vol. 31, Supp 1, pp. 162-163, 2000.

Podlinski, et al., "EHD flow in a wide electrode spacing spike-plate electrostatic precipitator under positive polarity," Journal of Electrostatics, vol. 64, No. 7-9, pp. 498-505, 2006.

Prabhu, et al., "Electrostatic Precipitation of Powdered Activated Carbon and Implications for Secondary Mercury Adsorption within Electrostatic Precipitators," Energy & Fuels, vol. 25, No. 3, pp. 1010-1016, 2011.

Quast, et al., "Measuring and calculation of positive corona currents using comsol Multiphysics," Proceedings of the 3rd Annual European COMSOL Conference, pp. 1-7, 2009.

Viner, et al., "Ozone generation in dc-energized electrostatic precipitators," IEEE Transactions on Industry Applications, vol. 28, No. 3, pp. 504-512, 1992.

Wen, et al., "Novel electrodes of an electrostatic precipitator for air filtration," Journal of Electrostatics, vol. 73, pp. 117-124, 2015.

Yanallah, et al., "Ozone generation using negative wire-to-cylinder corona discharge: the influence of anode composition and radius," 2008 IEEE Annual Report Conference on Electrical Insulation and Dielectric Phenomena, pp. 607-610, 2008.

* cited by examiner

ELECTROSTATIC PRECIPITATOR

CROSS-REFERENCE TO RELATED APPLICATIONS

This application claims the benefit of U.S. Provisional Applications No. Patent Application 62/049,297 filed Sep. 11, 2014 ("Maximizing the effectiveness of electrostatic air cleaners via the use of a non-uniform transverse electric field distribution in the particle collection stage"), the disclosure of which is incorporated herein by reference in its entirety.

BACKGROUND OF THE INVENTION

1. Field of the Invention

The present technology relates generally to an electrostatic precipitator and particularly an electrostatic precipitator for use in heating, air-conditioning, and ventilation (HVAC) systems or other systems for cleaning gases including without limitation industrial electrostatic precipitators and other forms of electrostatic filtration.

2. Description of the Related Technology

The most common types of residential or commercial HVAC filters employ a fibrous filter media (made from polyester fibers, glass fibers or microfibers, etc.) placed substantially perpendicular to the airflow through which air may pass (e.g., an air conditioner filter, a HEPA filter, etc.) such that particles are removed from the air mechanically (coming into contact with one or more fibers and either adhering to or being blocked by the fibers); some of these filters are also electrostatically charged (either passively during use, or actively during manufacture) to increase the chances of particles coming into contact and staying adhered to the fibers.

Fibrous media filters typically have to be cleaned and/or replaced regularly due to an accumulation of particles. Furthermore, fibrous media filters are placed substantially perpendicular to the airflow, increasing airflow resistance and causing a significant static pressure differential across the filter, which increases as more particles accumulate or collect in the filter. Pressure drop across various components of an HVAC system is a constant concern for designers and operators of mechanical air systems, since it either slows the airflow or increases the amount of energy required to move the air through the system. Accordingly, there exists a need for an air filter capable of relatively long intervals between cleaning and/or replacement and a relatively low pressure drop across the filter after installation in an HVAC system.

Another form of air filter is known as an electrostatic precipitator. A conventional electrostatic precipitator includes one or more corona electrodes and one or more smooth metal electrode plates that are substantially parallel to the airflow. The corona electrodes produce a corona discharge that ionizes air molecules in an airflow received into the filter. The ionized air molecules impart a net charge to nearby particles (e.g., dust, dirt, contaminants etc.) in the airflow. The charged particles are subsequently electrostatically attracted to one of the electrode plates and thereby removed from the airflow as the air moves past the electrode plates. After a sufficient amount of air passes through the filter, the electrodes can accumulate a layer of particles and dust and eventually need to be cleaned. Cleaning intervals may vary from, for example, thirty minutes to several days. Further, since the particles are on an outer surface of the electrodes, they may become re-entrained in the airflow since a force of the airflow may exceed the electric force attracting the charged particles to the electrodes, especially if many particles agglomerate through attraction to each other, thereby reducing the net attraction to the collector plate. Such agglomeration and re-entrainment may require use of a media filter that is placed substantially perpendicular to the airflow, thereby increasing airflow resistance.

U.S. patent application Ser. No. 14/401,082 filed on 15 May 2013 and published 21 Nov. 2013, the disclosure of which is expressly incorporated by reference herein shows an electrostatic precipitator with improved performance. An article by Wen, T.; Wang, H.; Krichtafovitch, I.; and Mamishev, A. entitled *Novel Electrodes of an Electrostatic Precipitator for Air Filtration*, submitted to the Journal of Electrostatics, Nov. 12, 2014, the disclosure of which is expressly incorporated herein by reference, presents working principles of electrostatic precipitators and provides a discussion on the design concepts and schematics of a foam-covered ESP. The collector electrodes in the electrostatic precipitator described therein may be covered with porous foam. Electrostatic precipitators with foam-covered electrodes have improved capacity for particle collection, due in part, to the increased surface area of foam over metal collector plates and improved filtration efficiency because the effect of particle re-entrainment is reduced. Nevertheless, foam-covered electrostatic precipitators described in U.S. application Ser. No. 14/401,082 would have even better performance in some environments, particularly very dusty areas, if the collection capacity were increased thereby reducing the frequency of foam collector cleaning or replacement.

Particles capture and retention should be improved, especially while filtering wide range of the particles: from micron size to sub-micron and ultra-fine (e.g., nanometer) size particles.

SUMMARY OF THE INVENTION

It is an object of the invention to maximize the dust holding capacity of a filter by a non-uniform electric field distribution between the repelling and the collecting electrodes and thereby distribute the captured dust particles across a larger portion of the collector electrode.

It is another object of the invention to improve particle capture and retention for a wide range of particle: from micron size to sub-micron and ultra-fine (e.g., nanometer) size particles.

An electrostatic precipitator electrode assembly may include a plurality of first electrodes and a plurality of second electrodes. The first electrodes may be collector electrodes and the second electrodes may be repelling electrodes. The first and second electrodes may be a different electrical potentials. The first electrodes may include an outer surface generally parallel with an airflow through an electrostatic precipitator cavity. At least one of said first electrodes and said second electrodes may include two or more portions maintained at different voltages along an airflow path and may further include a first portion comprising a porous open cell material. At least one of the collector electrodes may have a core including conductive portions having physical characteristics to be at different potentials along the length of the electrode. A porous material may be mounted on the core of the first electrode. The porous material may be open-cell foam. The material may be separated into segments having different electrical properties Various objects, features, aspects, and advantages of the present invention will become more apparent from the following detailed description of preferred embodiments of the invention, along with the accompanying drawings in which like numerals represent like components.

Moreover, the above objects and advantages of the invention are illustrative, and not exhaustive, of those that can be achieved by the invention. Thus, these and other objects and advantages of the invention will be apparent from the description herein, both as embodied herein and as modified in view of any variations which will be apparent to those skilled in the art.

DETAILED DESCRIPTION OF A PREFERRED EMBODIMENT

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It must be noted that as used herein and in the appended claims, the singular forms "a", "an", and "the" include plural referents unless the context clearly dictates otherwise.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

Figure 2:
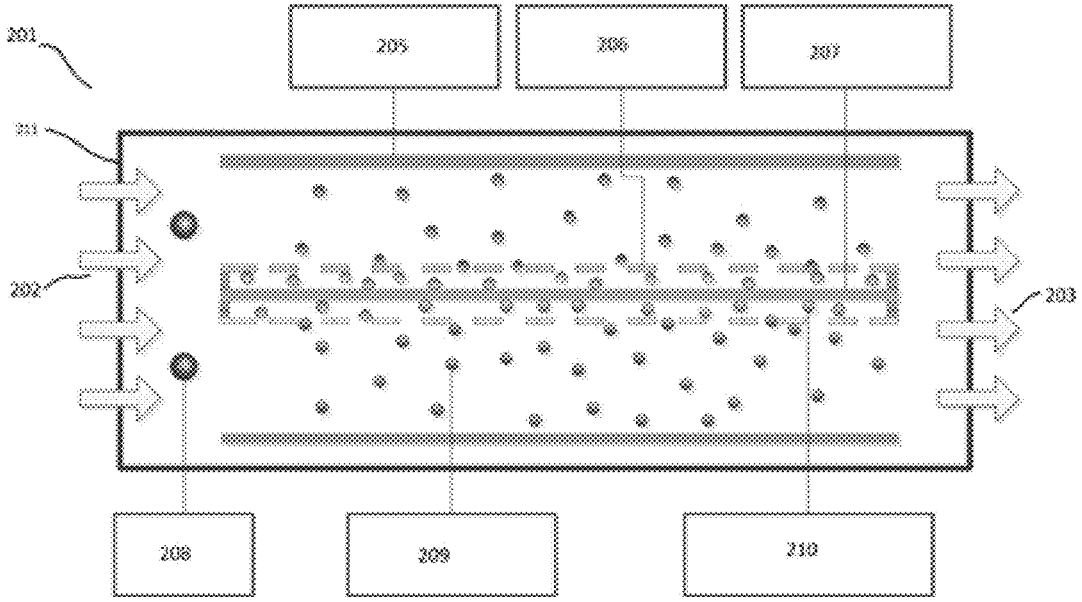
FIG. 2 illustrates basic concept of foam-covered electrostatic precipitator.

The present technology relates generally to cleaning gas flows using electrostatic precipitators and associated systems and methods. In one aspect of the present technology, shown in FIG. 2, an electrostatic precipitator 201 that may include a housing 211 having an inlet 202, an outlet 203, and a cavity there between. It may include corona electrodes 208 which are in this example thin electrically conductive wires connected to a power source (not shown). An electrode assembly may be positioned in the air filter between the inlet and the outlet and may include a plurality of first electrodes 207 (e.g., collecting electrodes) and a plurality of second electrodes 205 (e.g., repelling electrodes), both arranged substantially parallel to the air flow path. The first electrode plate 207 is covered with porous open cell material 206. When sufficient voltage (several kilovolts) is applied to the corona electrodes 208 they emit ions that are blown from the left to the right as shown by arrows. These ions may attach to the particles in the air 209. When voltage is also applied to the second electrodes 205 an electric field is created between the first electrode plate 207 and the second electrode 205. Under the influence of the force of the electric field, charged particles 209 may be pushed toward the plate 207. Particles 210 are thus collected on the first electrode's 207 porous open cell material 206. For simplicity only a single collection electrode and two repelling electrodes are show, however an actual device would normally have a plurality of alternating repelling and collection electrodes.

In an aspect of the present technology, a method of filtering air may include creating an electric field using a plurality of corona electrodes arranged in an airflow path The corona electrodes may be positioned to ionize a portion of the molecules in the airflow path. The method may also include applying a first electric potential at a plurality of first electrodes spaced apart from the corona electrodes, and receiving, at the first collection portion, particulate matter electrically coupled to the ionized air molecules. An electric field is established based on the voltage difference between the first electrodes and the second electrodes.

According to an embodiment of the invention the first and or second electrodes may be configured to establish different electric field strengths along the airflow path.

Figure 1:
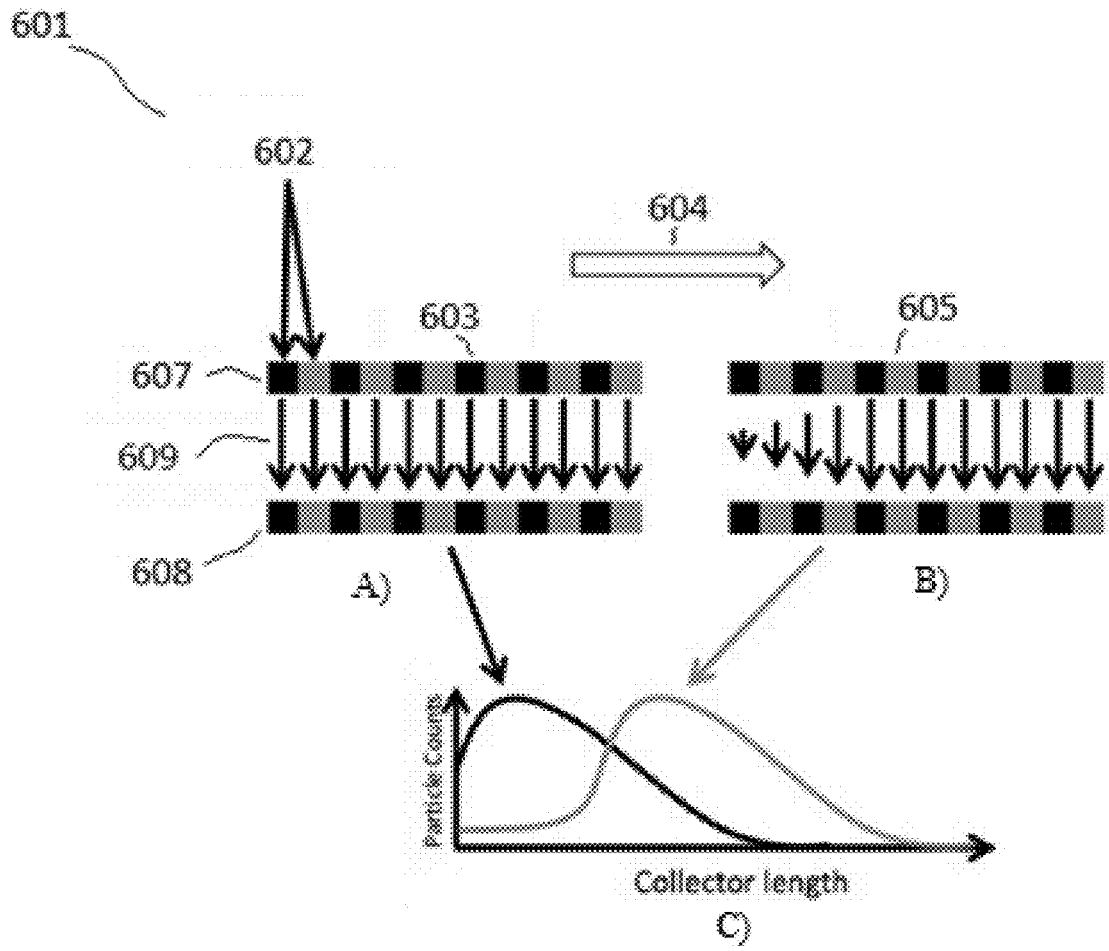
FIG. 1A) illustrates field strength between collecting and repelling electrodes in an electrostatic precipitator. B) illustrates field strength between collecting and repelling electrodes in an electrostatic precipitator. C) illustrates a schematic view particle collection in accordance with the configurations of FIGS. 1A) and 1B) respectively.

The voltage of the second electrode (i.e. electric field strength between the first and second electrodes) may be set at a high value at the upstream edge of the first electrode length. The voltage may be decreased gradually or in steps in the downstream direction. The electric field strength in the air flow path is related to the difference of the voltage of the first and second electrodes at any point. This will allow for a larger spread of captured dust particles (in the downstream direction) across the length of the first electrode, increasing the dust filtration efficiency and dust holding capacity of the electrostatic precipitator. FIG. 1 shows schematically, an electrode structure of electrostatic precipitator 601 (603 and 605. FIG. 1 shows an electrode 608 and the electrode 607. The airflow path may be between the electrode 607 and the electrode 608 with airflow in the direction of arrow 604. According to the illustrated embodiment, each electrode may contain alternating electrically conductive (dark) and electrically insulating (light) segments 602. FIG. 1A shows an example with a uniform electric field between electrodes 608 and electrode 603. FIG. 1B shows an example with a non-uniform electric field between electrodes 608 and electrode 605. The electric field between the electrodes is shown by the arrows 609. The electrical potential applied to the first and to the second electrodes' segments may be of different values. Therefore the electric field strength between the electrode 608 and the electrode 607 may vary along the length of the electrodes, i.e., in the direction of the air flow which is shown by the arrow 604. FIG. 1C shows a chart with an illustration of the particles collection efficiency. The dark line depicts particle collection when electric field is uniform along the length of the first electrode. When the electric field is uniform, greater particle collection may occur near the front part (upstream) of the electrode. Fewer particles may be collected at the downstream portion of the electrode. The upstream portion of the collector electrode may become saturated with particles before the downstream portion. The light line shows an illustration of the particle count versus collector length when a non-uniform electric field is present along the length of the first electrode. Fewer particles are collected on the front part of the first electrode while more particles are collected further downstream.

The electric field strength distribution gradient can be achieved by sectioning the inner or outer portions of the first or/and second electrodes into multiple segments, electrically isolating each segment from each other and applying an appropriate voltage to segments. The voltage gradient may be optimized experimentally by modifying the voltages over the length of the collector or time in service. The number of segments in a given electrode may be greater than three, greater than 10, etc. Spacing between segments of the first and second electrodes may be matched, such that the position and size of each of one or more segments on the electrode aligns with the position and size of a corresponding electrode.

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology, as those skilled in the relevant art will recognize. The scope of the claims is intended to cover such modifications and changes that fall within the true spirit of the invention. The inventive subject matter is not limited or restricted except in the spirit of the disclosure.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Where the context permits, singular or plural terms may also include the plural or singular term, respectively. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the spirit of the invention. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

The invention is described in detail with respect to preferred embodiments, and it will now be apparent from the foregoing to those skilled in the art that changes and modifications may be made without departing from the invention in its broader aspects, and the invention, therefore, as defined in the claims, is intended to cover all such changes and modifications that fall within the true spirit of the invention.

Thus, specific apparatus for and methods of electrostatic precipitation and particle collection have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context.

We claim:

1. An electrostatic precipitator electrode assembly, comprising:

a plurality of first electrodes and a plurality of second electrodes, wherein the first electrodes include an outer surface generally parallel with an airflow through an electrostatic precipitator cavity, and wherein at least one of said first electrodes and said second electrodes includes two or more portions maintained at different voltages along an airflow path and further include a first portion comprising a porous open cell material.

2. An electrostatic precipitator according to claim 1 wherein said first electrodes are collector electrodes.

3. An electrostatic precipitator according to claim 2 wherein at least one of said collector electrodes have a core including conductive portions having physical characteristics to be at different potentials along their length.

4. An electrostatic precipitator according to claim 2 wherein said collector electrodes further comprise a core and a porous material mounted on said core.

5. An electrostatic precipitator according to claim 3 wherein said porous material is open-cell foam.

6. The electrostatic precipitator according to claim 4, wherein said porous material comprises two or more separated segments having different electrical properties.

* * * * *